US011686201B2

(12) United States Patent
Tsuruta et al.

(10) Patent No.: US 11,686,201 B2
(45) Date of Patent: Jun. 27, 2023

(54) TURBINE ROTOR WITH BOLT FASTENING ARRANGEMENT AND PASSAGES

(71) Applicant: TOSHIBA ENERGY SYSTEMS & SOLUTIONS CORPORATION, Kawasaki (JP)

(72) Inventors: Kazutaka Tsuruta, Yokohama Kanagawa (JP); Takashi Suzuki, Tokyo (JP); Hideyuki Maeda, Yokohama Kanagawa (JP); Yuta Ishikawa, Tokyo (JP); Masao Itoh, Yokohama Kanagawa (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 145 days.

(21) Appl. No.: 17/182,396

(22) Filed: Feb. 23, 2021

(65) Prior Publication Data

US 2021/0348512 A1 Nov. 11, 2021

(30) Foreign Application Priority Data

Mar. 12, 2020 (JP) ..... 2020-043185

(51) Int. Cl.
*F01D 5/02* (2006.01)
*F01D 5/08* (2006.01)

(52) U.S. Cl.
CPC ..... *F01D 5/026* (2013.01); *F01D 5/085* (2013.01); *F05D 2220/32* (2013.01);
(Continued)

(58) Field of Classification Search
CPC . F01D 5/026; F01D 5/06; F01D 5/066; F01D 5/08; F01D 5/085; F01D 25/12;
(Continued)

(56) References Cited

U.S. PATENT DOCUMENTS 6,227,799 B1 * 5/2001 Kuhn ..... F01D 5/081 415/115
7,267,525 B2 * 9/2007 Hiegemann ..... F01D 5/085 415/115

(Continued)

FOREIGN PATENT DOCUMENTS

EP 1 911 933 A1 4/2008
JP 58005401 A * 1/1983 ..... F01D 5/085

(Continued)

OTHER PUBLICATIONS

JP58005401A_MachineTranslation (Shibaoka, H.) Jan. 12, 1983. [retrieved on Sep. 8, 2022] Retrieved from: Espacenet (Year: 1983).*

*Primary Examiner* — Woody A Lee, Jr.
*Assistant Examiner* — Elton K Wong
(74) *Attorney, Agent, or Firm* — Foley & Lardner LLP

(57) ABSTRACT

A turbine rotor in an embodiment is configured by joining a rotor component member and a rotor component member together by bolt fastening with an abutting end surface of the rotor component member and an abutting end surface of the rotor component member abutting on each other. The turbine rotor includes: a cylindrical recessed portion that is formed at the abutting end surface and is recessed in an axial direction; an axial passage bored from a bottom surface of the cylindrical recessed portion in the axial direction; an introduction passage introducing the cooling medium into the axial passage; a discharge passage discharging the cooling medium from the axial passage; and a sealing member that is arranged in the cylindrical recessed portion and seals one end of the axial passage.

12 Claims, 3 Drawing Sheets

(52) U.S. Cl.
CPC ..... *F05D 2240/24* (2013.01); *F05D 2240/61* (2013.01); *F05D 2260/20* (2013.01)

(58) Field of Classification Search
CPC ..... F05D 2240/24; F05D 2240/60; F05D 2240/61; F05D 2260/20; F05D 2220/32
See application file for complete search history.

(56) References Cited

U.S. PATENT DOCUMENTS

| | | | | |
|---|---|---|---|---|
| 2012/0210722 | A1* | 8/2012 | Hynum | F01D 5/081 415/121.2 |
| 2016/0376890 | A1* | 12/2016 | Inomata | F01D 5/08 416/96 R |
| 2018/0202360 | A1* | 7/2018 | Mukhopadhyay | F01D 25/24 |

FOREIGN PATENT DOCUMENTS

| | | | |
|---|---|---|---|
| JP | 2007-321630 | A | 12/2007 |
| WO | WO-01/88354 | A2 | 11/2001 |

* cited by examiner

TURBINE ROTOR WITH BOLT FASTENING ARRANGEMENT AND PASSAGES

CROSS REFERENCE TO RELATED APPLICATIONS

This application is based upon and claims the benefit of priority from Japanese Patent Application No. 2020-043185, filed on Mar. 12, 2020; the entire contents of which are incorporated herein by reference.

FIELD

Embodiments described herein relate generally to a turbine rotor.

BACKGROUND

In recent years, in order to improve the efficiency of a power generation plant, there has been studied a gas turbine facility in which as a supercritical working fluid, a part of a combustion gas produced in a combustor is circulated through a system (to be referred to as a CO2 gas turbine facility below). In the combustor, a hydrocarbon-based fuel and oxygen are burned.

Here, in the combustor of the $CO_2$ gas turbine facility, flow rates of the fuel and oxygen are adjusted, for example, to achieve a stoichiometric mixture ratio (an equivalence ratio of 1). Therefore, carbon dioxide ($CO_2$) obtained by water vapor being removed from the combustion gas circulates through the system.

Incidentally, the equivalence ratio mentioned here is the equivalence ratio calculated based on the fuel flow rate and the oxygen flow rate. In other words, it is the equivalence ratio (an overall equivalence ratio) when the fuel and oxygen are assumed to be uniformly mixed.

The circulating carbon dioxide is pressurized above the critical pressure by a compressor and supplied to the combustor and the turbine. The supercritical carbon dioxide supplied to the turbine functions as a cooling medium, for example. The turbine includes a cooling mechanism that cools a turbine rotor, stator blades, and rotor blades by the introduced supercritical carbon dioxide (cooling medium).

Here, FIG. 5 is a view illustrating a meridian cross section of a turbine 300 in a $CO_2$ gas turbine facility. Incidentally, in FIG. 5, some components of the turbine 300 are omitted.

As illustrated in FIG. 5, the turbine 300 includes an outer casing 310 and an inner casing 311 inside the outer casing 310. Further, a turbine rotor 340 is provided through the inner casing 311 and the outer casing 310.

An outer shroud 320 is provided on an inner periphery of the inner casing 311 over the circumferential direction, and an inner shroud 321 is provided at the inner side of this outer shroud 320 over the circumferential direction. Then, between the outer shroud 320 and the inner shroud 321, a plurality of stator blades 322 are supported in the circumferential direction to form a stator blade cascade.

Here, the circumferential direction is the circumferential direction centered on a center axis O of the turbine rotor, that is, the direction around the center axis O. At the inner side of the inner shroud 321, a sealing part 325 is formed.

Here, the turbine rotor 340 includes a later-described center passage 370 formed along the center axis of the turbine rotor as the cooling mechanism. In this turbine rotor 340, it is necessary to periodically inspect the condition of the center passage. For this reason, as the turbine rotor, there is used a turbine rotor in which a plurality of rotor component members are joined in the center axis direction of the turbine rotor (to be referred to as the axial direction below).

Further, when such a jointed turbine rotor is employed, it is preferred to be able to easily separate the respective rotor component members for inspection. Therefore, a turbine rotor in which the respective rotor component members are joined by bolt fastening is employed.

The turbine rotor 340 includes a rotor component member 340A and a rotor component member 340B as illustrated in FIG. 5. The rotor component member 340A is arranged on the exhaust side relative to the rotor component member 340B. Here, the exhaust side is the side of an exhaust hood (not illustrated) in the axial direction, which is the right side in the axial direction in FIG. 5. For convenience of explanation, the exhaust hood side in the axial direction is referred to as the exhaust side, and the side opposite to the exhaust hood side in the axial direction is referred to as the compressor side.

The rotor component member 340A and the rotor component member 340B are bolted together by bolts 345 and nuts 346, with one end surface 343 and one end surface 344 abutting on each other.

The rotor component member 340A includes a rotor wheel 341 projecting to the radially outer side over the circumferential direction. The rotor wheel 341 is provided in a plurality of stages in the axial direction. Then, a plurality of rotor blades 350 are implanted in each rotor wheel 341 in the circumferential direction to form a rotor blade cascade.

The stator blade cascade and the rotor blade cascade are provided alternately in the axial direction. Then, the stator blade cascade and the rotor blade cascade immediately downstream from the stator blade cascade form a turbine stage. Note that the term downstream means a downstream side with respect to the main flow direction of a working fluid.

The cooling mechanism for cooling the turbine rotor 340 by the cooling medium is provided in the rotor component member 340A.

The cooling mechanism includes, for example, the center passage 370, an introduction passage 371, and a discharge passage 372.

The center passage 370 is made of a cylindrical hole extending in the axial direction with the center axis O of the turbine rotor 340 set as the center axis as illustrated in FIG. 5. One end 370*a* of the center passage 370 is located at the one end surface 343 of the rotor component member 340A. That is, the center passage 370 is formed from the one end surface 343 of the rotor component member 340A toward the exhaust side.

The one end 370*a* of the center passage 370 is sealed by the one end surface 344 of the rotor component member 340B.

The introduction passage 371, which leads the cooling medium into the center passage 370, is formed in the radial direction to be communicated with an upstream portion of the center passage 370.

The discharge passage 372 is formed in the radial direction to be communicated with the center passage 370. A plurality of the discharge passages 372 are provided in the axial direction so as to enable the cooling medium to be discharged into a space 363 between the inner shroud 321 in each of the turbine stages and the turbine rotor 340. Incidentally, the radial direction is the direction vertical to the center axis O, with the center axis O set as a base point.

As illustrated in FIG. 5, a transition piece 360, which leads the combustion gas produced in the combustor (not illustrated) to the first-stage stator blades 322, is provided through the outer casing 310 and the inner casing 311. A cooling medium supply pipe 362, which supplies the cooling medium into a space 361 inside the inner casing 311, is provided around an outer periphery of the transition piece 360.

On the compressor side relative to the space 361, gland sealing parts 380 are provided between the inner casing 311 and the turbine rotor 340. In addition, on the compressor side relative to the gland sealing part 380, gland sealing parts 390 are provided between the outer casing 310 and the turbine rotor 340.

Incidentally, a joint portion of the rotor component member 340A and the rotor component member 340B is located at the position in the axial direction where the gland sealing parts 380 are provided.

Here, the cooling medium supplied into the space 361 from an annular passage between the cooling medium supply pipe 362 and the transition piece 360 is led to the center passage 370 through the introduction passage 371. Then, the cooling medium flowing through the center passage 370 is discharged into the space 363 through the discharge passage 372.

In the above-described turbine 300, the pressure of the cooling medium led from the space 361 to the center passage 370 is a very high pressure of about 30 MPa, for example. On the other hand, the pressure of the gland sealing part 380 around the joint portion of the rotor component member 340A and the rotor component member 340B is, for example, about 5 MPa.

As above, the difference between the pressure inside the center passage 370 and the pressure inside the gland sealing part 380 is large. Thus, in order to prevent leakage of the cooling medium from the one end 370*a* of the center passage 370, the joint portion of the rotor component member 340A and the rotor component member 340B is required to have an excellent sealing property.

That is, the joint portion of the rotor component member 340A and the rotor component member 340B needs to have a function of transmitting a shaft power as well as a function of preventing the leakage of an ultra-high pressure cooling medium from an abutting surface of the rotor component member 340A and the rotor component member 340B. Therefore, the bolt fastening structure is excess-designed.

Further, the surface of the one end surface 344 of the rotor component member 340B, which seals the one end 370*a* of the center passage 370, receives the pressure of the cooling medium. Therefore, the rotor component member 340B receives force toward the compressor side. As a result, the force toward the compressor side is loaded on the bolts 345 and the nuts 346. Therefore, there is a concern that the bolt fastening structure may be damaged. Further, in order to prevent the damage to the bolt fastening structure, excess design is required.

DETAILED DESCRIPTION

Hereinafter, there will be explained an embodiment of the present invention with reference to the drawings.

In one embodiment, a turbine rotor is configured by joining a first rotor component member and a second rotor component member together by bolt fastening with a first end surface of the first rotor component member and a second end surface of the second rotor component member abutting on each other.

This turbine rotor includes: a cylindrical recessed portion that is formed at the first end surface and is recessed in a center axis direction of the turbine rotor; an axial passage that is bored from a bottom surface of the cylindrical recessed portion in the center axis direction of the turbine rotor and through which a cooling medium flows; an introduction passage that introduces the cooling medium into the axial passage; a discharge passage that penetrates from the axial passage into an outer peripheral surface of the turbine rotor and discharges the cooling medium, and a sealing member that is arranged in the cylindrical recessed portion and seals one end of the axial passage.

Hereinafter, there will be explained an embodiment of the present invention with reference to the drawings.

Figure 1:
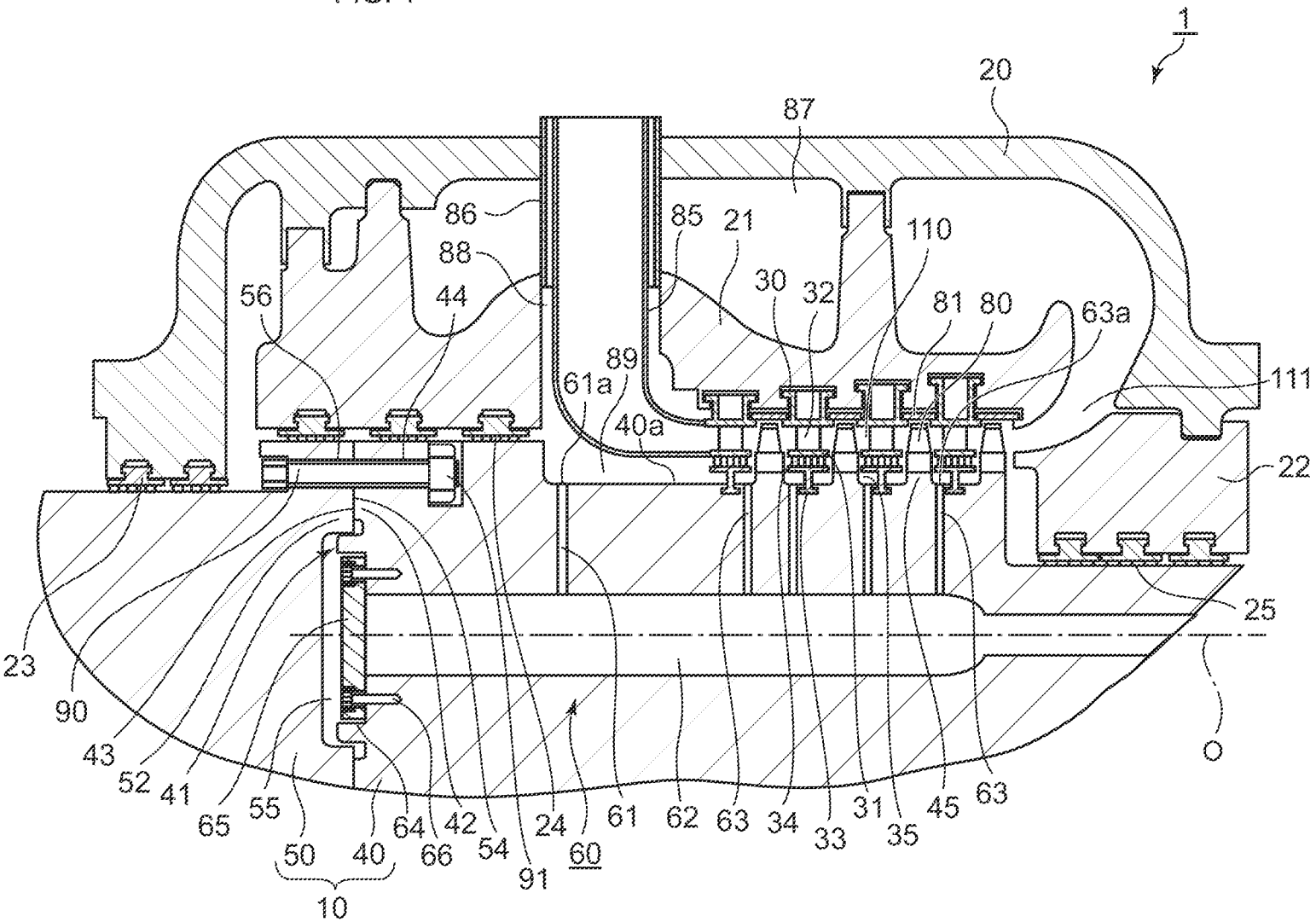
FIG. 1 is a view illustrating a meridian cross section of an axial flow turbine including a turbine rotor in an embodiment.

FIG. 1 is a view illustrating a meridian cross section of an axial flow turbine 1 including a turbine rotor 10 in the embodiment. Incidentally, FIG. 1 illustrates a turbine structure of a gas turbine.

As illustrated in FIG. 1, the axial flow turbine 1 includes an outer casing 20 and an inner casing 21 inside the outer casing 20. Further, the turbine rotor 10 is provided through the inner casing 21 and the outer casing 20.

An outer shroud 30 is provided on an inner periphery of the inner casing 21 over the circumferential direction. An inner shroud 31 is provided at the inner side of this outer shroud 30 (a radially inner side) over the circumferential direction. Then, between the outer shroud 30 and the inner shroud 31, a plurality of stator blades 32 are supported in the circumferential direction to form a stator blade cascade. This stator blade cascade is provided in a plurality of stages in the axial direction (the direction of a center axis O of the turbine rotor 10).

Here, the radially inner side is the side approaching the center axis O in the radial direction (the center axis O side).

At the inner side of the inner shroud 31, for example, a heat shield piece 33 is provided over the circumferential direction in a manner to face the inner shroud 31. The heat shield piece 33 is implanted in the turbine rotor 10, for example. A sealing part 34 is formed between the inner shroud 31 and the heat shield piece 33.

The turbine rotor 10 includes a rotor component member 40 and a rotor component member 50. The turbine rotor 10 is configured by joining the rotor component member 40 and the rotor component member 50 together by bolt fastening. Both ends of the turbine rotor 10 are rotatably supported by bearings (not illustrated).

Incidentally, the rotor component member 40 functions as the first rotor component member, and the rotor component member 50 functions as the second rotor component member.

The rotor component member 40 is formed of a column-shaped member. The rotor component member 40 includes a rotor wheel 45 and a cooling structure part 60.

The rotor wheel 45 projects to a radially outer side from an outer peripheral surface of the rotor component member 40 over the circumferential direction. This rotor wheel 45, which is formed of an annular projecting body, is provided in a plurality of stages in the axial direction. Here, the radially outer side is the side that is going away from the center axis O in the radial direction.

In a tip portion of each of the rotor wheels 45, a plurality of rotor blades 40 are implanted in the circumferential direction to form a rotor blade cascade. An outer periphery of the rotor blades 40 is surrounded by a shroud segment 81, for example. The shroud segment 81 is supported by the outer shroud 30.

Incidentally, the stator blade cascade and the rotor blade cascade are provided alternately in the axial direction. Then, the stator blade cascade and the rotor blade cascade immediately downstream from the stator blade cascade form a turbine stage.

The cooling structure part 60 includes a structure that cools the turbine rotor 10 by a cooling medium. This structure will be explained in detail later.

The rotor component member 50 is formed of a column-shaped member. The rotor component member 50 is arranged on the compressor side relative to the rotor component member 40.

Figure 2:
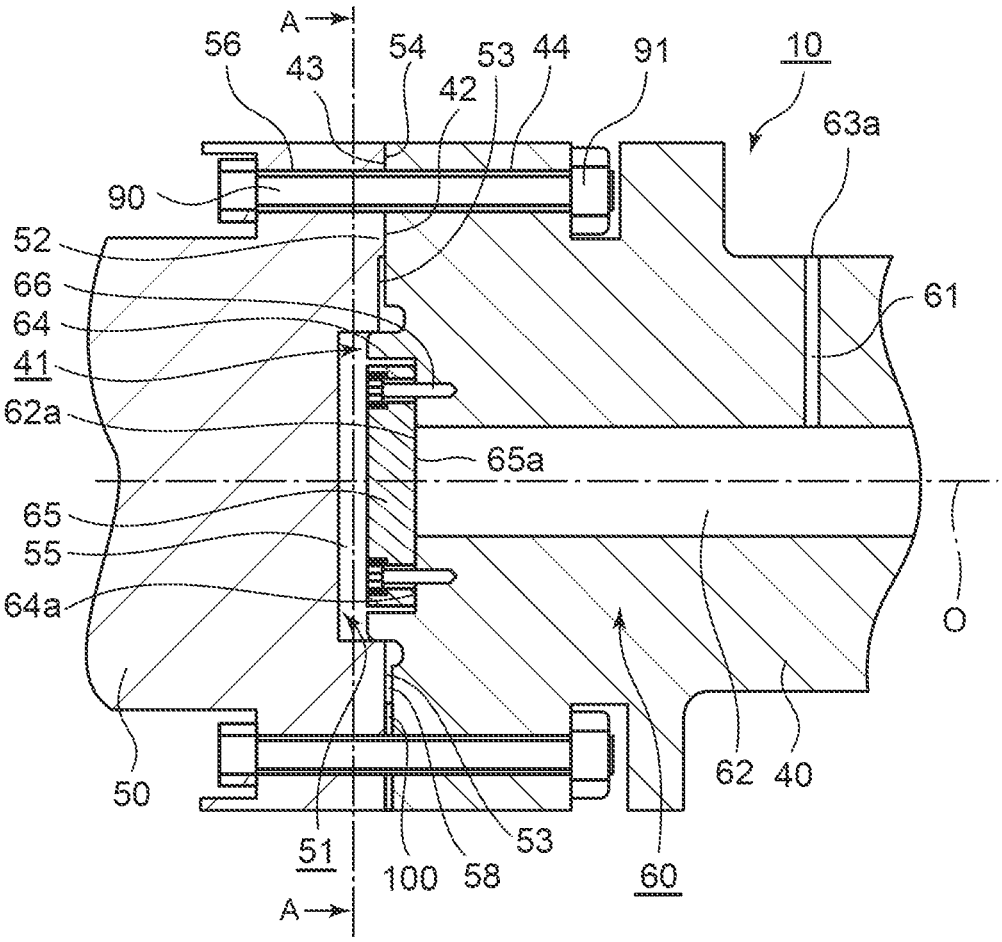
FIG. 2 is a view illustrating a meridian cross section of a joint portion of the turbine rotor in the embodiment.
Figure 3:
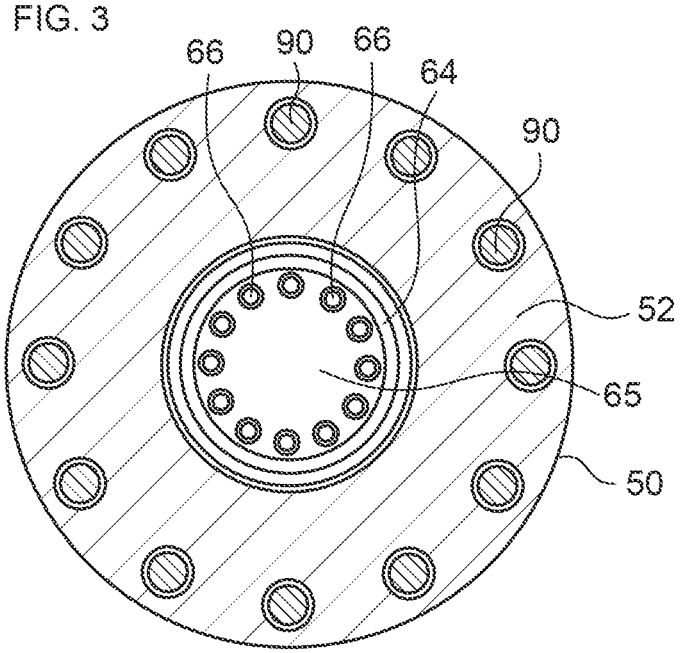
FIG. 3 is a view illustrating a cross section taken along A-A in FIG. 2.

Here, there is explained a bolt fastening structure, which is a configuration of a joint portion of the rotor component member 40 and the rotor component member 50. FIG. 2 is a view illustrating a meridian cross section of the joint portion of the turbine rotor 10 in the embodiment. FIG. 3 is a view illustrating a cross section taken along A-A in FIG. 2.

As illustrated in FIG. 2 and FIG. 3, on the outer edge side (radially outer side) of an end surface (end surface on the compressor side) 41 of the rotor component member 40, an annular groove portion 42 that is recessed in the axial direction is provided over the circumferential direction. That is, the outer edge side of the end surface of the rotor component member 40 includes the annular groove portion 42 made of a step portion recessed to the exhaust side in the axial direction over the circumferential direction. Incidentally, the end surface 41 functions as the first end surface.

In the meantime, on the outer edge side (radially outer side) of an end surface (end surface on the exhaust side) 51 of the rotor component member 50, an annular projecting portion 52 that projects in the axial direction is provided over the circumferential direction. That is, the outer edge side of the end surface of the rotor component member 50 includes the annular projecting portion 52 made of a step portion projecting to the exhaust side in the axial direction over the circumferential direction. Incidentally, the end surface 51 functions as the second end surface.

Further, on the inner edge side (radially inner side) of an end surface of the annular projecting portion 52, an annular recessed portion 53 made of a step portion recessed to the compressor side in the axial direction is formed over the circumferential direction.

Then, the rotor component member 40 and the rotor component member 50 are connected with the annular groove portion 42 and the annular projecting portion 52 being fitted to each other. The annular groove portion 42 and the annular recessed portion 52 are fitted to each other to be connected, and thereby positioning in the direction vertical to the axial direction can be easily performed.

When the annular groove portion 42 and the annular projecting portion 52 are fitted to each other, an abutting end surface 43, which is an annular bottom surface of the annular groove portion 42, and an abutting end surface 54 of the annular projecting portion 52, which is on the outer edge side relative to the annular recessed portion 53, come into contact with each other.

The abutting end surface 43 is an annular end surface on the outer edge side (radially outer side) of the annular bottom surface of the annular groove portion 42. The abutting end surface 54 is an annular end surface of the annular projecting portion 52, which is on the outer edge side relative to the annular recessed portion 53.

Here, as illustrated in FIG. 2, there is a clearance in the axial direction between the end surface 41 of the rotor component member 40 and the end surface 51 of the rotor component member 50 at the center portion centered on the center axis O. As a result, the center portion of the joint portion of the rotor component member 40 and the rotor component member 50 has a cylindrical space 55 formed in the clearance. The cylindrical space 55 is formed to face a later-described cylindrical recessed portion 64. Incidentally, the cylindrical space 55 functions as a space portion.

In the rotor component member 40 and the rotor component member 50, bolt holes 44, 56 allowing a bolt 90 to pass therethrough are formed on the outer edge side of the abutting end surfaces 43, 54. The bolt 90 passes through these bolt holes 44, 56 to be screwed into nuts 91. As illustrated in FIG. 3, a plurality of joint portions by this bolt fastening are evenly provided in the circumferential direction.

As above, the turbine rotor 10 in the axial flow turbine 1 includes the above-described bolt fastening structure.

Further, in the axial flow turbine 1, as illustrated in FIG. 1, gland sealing parts 23, 24, and 25 that inhibit leakage of a working fluid to the outside are provided between the turbine rotor 10 and the inner casing 21, between the turbine rotor 10 and the outer casing 20, and between the turbine rotor 10 and a packing head 22.

Here, the joint portion of the rotor component member 40 and the rotor component member 50 is located at the position in the axial direction where the gland sealing parts 24 are located.

Further, in the axial flow turbine 1, a transition piece 85 is provided through the outer casing 20 and the inner casing 21. A downstream end of the transition piece 85 abuts on upstream ends of the inner shroud 31 and the outer shroud 30 supporting the first-stage stator blades. Then, the transition piece 85 leads a combustion gas produced in a combustor (not illustrated) to the first-stage stator blades 32.

In a penetration region where the transition piece 85 penetrates the outer casing 20 and the inner casing 21, an outer periphery of the transition piece 85 is surrounded by a cooling medium supply pipe 86 into which the cooling medium is introduced. That is, in the penetration region, a double-pipe structure composed of the transition piece 85 and the cooling medium supply pipe 86 provided around the outer periphery side of the transition piece 85 is provided.

In order to prevent the cooling medium that flows through an annular passage between the transition piece 85 and the cooling medium supply pipe 86 from flowing into a space 87 between the outer casing 20 and the inner casing 21, a downstream end of the cooling medium supply pipe 86 extends into a through opening 88 formed in the inner casing 21. Incidentally, the through opening 88 is an opening for allowing the transition piece 85 and the cooling medium supply pipe 86 to penetrate into the inner casing 21.

An outlet of the cooling medium supply pipe 86 is communicated with a space 89 in the inner casing 21 into which the transition piece 85 is inserted. That is, the cooling medium introduced from the cooling medium supply pipe 86 flows into the space 89.

Here, the configuration to supply the cooling medium into the space 89 is not limited to this configuration. That is, the cooling medium supply pipe 86 is not limited to the configuration provided around the transition piece 85. The cooling medium supply pipe 86 only needs to be configured to be capable of supplying the cooling medium into the space 89 through the outer casing 20 and the inner casing 21, for example.

Then, the cooling structure part 60 of the turbine rotor 10 is explained in detail.

As illustrated in FIG. 1, the cooling structure part 60 includes an introduction passage 61, an axial passage 62, a discharge passage 63, and a sealing member 65. The introduction passage 61, the axial passage 62, and the discharge passage 63 are communicated.

The introduction passage 61 introduces the cooling medium into the axial passage 62. The introduction passage 61 is formed of, for example, a through hole that penetrates from an outer peripheral surface 40*a* of the rotor component member 40 into the axial passage 62. The introduction passage 61 is formed, for example, in the radial direction.

Incidentally, the introduction passage 61 may be formed to have an inclination in the axial direction with respect to the radial direction. Further, the introduction passage 61 may be formed to have an inclination in the circumferential direction with respect to the radial direction.

An inlet 61*a* of the introduction passage 61 opens in the space 89 in the inner casing 21 into which the cooling medium is introduced. That is, the space 89 and the axial passage 62 are communicated through the introduction passage 61.

Incidentally, a plurality of the introduction passages 61 may be provided in the axial direction and the circumferential direction, for example. In this case, the cooling medium introduced into the space 89 flows into the axial passage 62 through a plurality of the introduction passages 61.

The axial passage 62 leads the cooling medium in the axial direction. The axial passage 62 is formed in the axial direction along the center axis O of the turbine rotor 10. Here, as illustrated in FIG. 2, the cylindrical recessed portion 64 recessed to the exhaust side in the axial direction is formed at the center of the end surface 41 of the rotor component member 40, centered on the center axis O. The cylindrical recessed portion 64 is formed of a cylindrical groove centered on the center axis O.

The axial passage 62 is formed of a hole bored in the axial direction from a bottom surface 64*a* of this cylindrical recessed portion 64. That is, one end 62*a* of the axial passage 62 opens in the bottom surface 64*a* of the cylindrical recessed portion 64.

As illustrated in FIG. 2 and FIG. 3, the sealing member 65 is formed of a plate-shaped member whose outer shape is formed to match the shape of the cylindrical recessed portion 64. Here, the sealing member 65 is formed of a circular plate-shaped member. The sealing member 65 is arranged in the cylindrical recessed portion 64. The thickness of the sealing member 65 is not particularly limited, but is set to the extent that, for example, the sealing member 65 does not project from the cylindrical recessed portion 64 to the compressor side (end surface 51 side).

One end surface 65*a* (an end surface on the exhaust side) of the sealing member 65 abuts on the bottom surface 64*a* of the cylindrical recessed portion 64. Then, the sealing member 65 is screwed to the cylindrical recessed portion 64 of the rotor component member 40. Concretely, the sealing member 65 is screwed to the bottom surface 64*a* of the cylindrical recessed portion 64 by screws 66. As illustrated in FIG. 3, the sealing member 65 is screwed to a plurality of places at equal intervals in the circumferential direction.

As a result, the sealing member 65 seals the one end 62*a* of the axial passage 62. In other words, the sealing member 65 blocks the axial passage 62 and the cylindrical space 55. Therefore, the cooling medium supplied into the axial passage 62 does not flow out to the cylindrical space 55 side.

The discharge passage 63 discharges the cooling medium flowing in the axial passage 62 to the outside from the inside of the rotor component member 40. As illustrated in FIG. 1, the discharge passage 63 consists of a through hole that penetrates from the axial passage 62 into the outer peripheral surface 40*a* of the rotor component member 40. Concretely, as illustrated in FIG. 1, the discharge passage 63 communicates the axial passage 62 with a space 35 between the heat shield piece 33 and the outer peripheral surface 40*a*.

A plurality of the discharge passages 63 are provided in the axial direction according to each of the turbine stages. In other words, the discharge passages 63 have an outlet 63*a* in the outer peripheral surface 40*a* of the rotor component member 40 on the upstream side of the first-stage rotor wheel 45 and outlets 63*a* each in the outer peripheral surface 40*a* of the rotor component member 40 between the respective rotor wheels 45.

The discharge passage 63 is formed in the radial direction, for example. Incidentally, the discharge passage 63 may be formed to have an inclination in the axial direction with respect to the radial direction. Further, the discharge passage 63 may be formed to have an inclination in the circumferential direction with respect to the radial direction.

Here, as the cooling medium, for example, a part of the working fluid of the gas turbine can be used by adjusting its temperature. That is, the working fluid, which has been extracted from the system of the gas turbine and adjusted to a predetermined temperature, can be used as the cooling medium.

For example, in the case of a supercritical $CO_2$ turbine, supercritical carbon dioxide, which is the working fluid, is used as the cooling medium. Concretely, the circulating supercritical carbon dioxide, which has been extracted from the system, is supplied to the axial flow turbine. Then, the supercritical carbon dioxide supplied to the axial flow turbine is introduced into the axial passage 62 as the cooling medium.

Here, as illustrated in FIG. 2, there is an annular gap 58 between the annular recessed portion 53 formed on the inner edge side (radially inner side) of the end surface of the annular projecting portion 52 and the abutting end surface 43. This gap 58 is communicated with the cylindrical space 55.

Then, in an abutting portion of the abutting end surface 43 and the abutting end surface 54, there may be provided a communication groove 100 communicating the gap 58 with the outside of the turbine rotor 10. Thereby, the cylindrical space 55 is communicated with the outside of the turbine rotor 10 through the gap 58 and the communication groove 100.

The communication groove 100 is formed in the radial direction, for example. Concretely, the communication groove 100 is formed of a slit or the like that is formed in the abutting end surface 43 or the abutting end surface 54 to communicate the gap 58 with the outside of the turbine rotor 10.

Further, the communication groove 100 may be provided in both the abutting end surface 43 and the abutting end surface 54. Incidentally, at least one communication groove 100 only needs to be provided in the circumferential direction in the abutting portion.

Providing the communication groove 100 makes it possible to discharge the cooling medium to the outside of turbine rotor 10 through the communication groove 100 even when, for example, the sealing member 65 is damaged to allow the cooling medium in the axial passage 62 to flow out into the cylindrical space 55. This makes it possible to prevent damage to a bolt fastening portion because the end surface 51 of the rotor component member 50 is not subjected to the force toward the compressor side.

Next, there are explained actions of the axial flow turbine 1 and the cooling structure part 60 of the turbine rotor 10 with reference to FIG. 1.

First, the action of the axial flow turbine 1 is explained.

The combustion gas produced in the combustor (not illustrated) is introduced into the axial flow turbine 1 through the transition piece 85. The combustion gas introduced into the axial flow turbine 1 is led to the first-stage stator blades 32. Then, the combustion gas is ejected from the first-stage stator blades 32 toward the first-stage rotor blades 80.

In this manner, the combustion gas flows through a combustion gas flow path 110 including the stator blades 32 and the rotor blades 80 in the second and subsequent stages while performing expansion work to rotate the turbine rotor 10. The combustion gas that has passed through the final-stage rotor blades 80 is discharged from the axial flow turbine 1 through an exhaust hood 111.

Next, the action of the cooling structure part 60 of the turbine rotor 10 is explained.

The cooling medium passes through the cooling medium supply pipe 86 and is led into the space 89 in the inner casing 21 into which the transition piece 85 is inserted. On this occasion, the cooling medium is led into the space 89 through the annular passage between the transition piece 85 and the cooling medium supply pipe 86.

Here, the outer peripheral surface 40*a* of the rotor component member 40 is cooled by the cooling medium led into the space 89. Further, the pressure of the cooling medium introduced into the space 89 is higher than the pressure of the combustion gas ejected from the transition piece 85.

A part of the cooling medium led into the space 89 flows into the introduction passage 61 from the inlet 61*a*. The cooling medium that has flowed into the introduction passage 61 flows into the axial passage 62 through the introduction passage 61. The flow rate of the cooling medium leading into the axial passage 62 is adjusted by a bore or the like of the introduction passage 61, for example.

The cooling medium led into the axial passage 62 flows through the axial passage 62 toward the exhaust side in the axial direction. On this occasion, since the one end 62*a* of the axial passage 62 is sealed by the sealing member 65, the cooling medium flows through the axial passage 62 in one direction (the exhaust side direction).

Further, since the one end 62*a* of the axial passage 62 is sealed, the pressure of the cooling medium in the axial passage 62 does not extend to the cylindrical space 55.

The cooling medium flowing to the downstream side in the axial direction in the axial passage 62 flows into the respective discharge passages 63 formed to correspond to the respective turbine stages. The cooling medium that has flowed into the discharge passage 63 flows through the discharge passage 63 to be ejected from the outlet 63*a* into the space 35 between the heat shield piece 33 and the outer peripheral surface 40*a* in each of the turbine stages.

Incidentally, the pressure of the cooling medium discharged from the discharge passage 63 is higher than the pressure inside the space 35. Here, the rotor component member 40 (the turbine rotor 10) is cooled from the inside by the cooling medium flowing through the introduction passage 61, the axial passage 62, and the discharge passages 63.

The cooling medium ejected into the space 35 flows into the combustion gas flow path 110 through a gap between the heat shield piece 33 and the rotor wheel 45 and a gap between the inner shroud 31 and the rotor wheel 45. The cooling medium that has flowed into the combustion gas flow path 110 flows through the combustion gas flow path 110 with the combustion gas to be discharged into the exhaust hood 111.

Here, the outer peripheral surface 40*a* of the rotor component member 40 facing the space 35 and the rotor wheel 45 are cooled by the cooling medium flowing into the space 35 and the cooling medium flowing out into the combustion gas flow path 110.

In the meantime, the remainder of the cooling medium led into the space 89 flows into the outer shroud 30, the sealing parts 34, and the gland sealing parts 23, 24. Incidentally, for example, the cooling medium is led into the outer shroud 30 to be used to cool the stator blades 32.

According to the turbine rotor 10 in the above-described embodiment, the one end 62*a* of the opening axial passage 62 can be sealed by the sealing member 65 at the joint portion by bolt fastening. As a result, the bolt fastening portion takes on the function of transmitting a shaft power, and the sealing member 65 takes on the function of sealing the one end 62*a* of the axial passage 62.

Thus, at the joint portion of the rotor component member 40 and the rotor component member 50, the shaft power transmitting function and the function of sealing the axial passage 62 can be shared by separate structures. As a result, the abutting end surfaces 43, 54 of the rotor component member 40 and the rotor component member 50 do not need to be provided with a function to seal the ultra-high pressure cooling medium. Therefore, it is possible to avoid the excessive design of the bolt fastening structure and make the structure of the bolt fastening portion simple.

Further, the sealing member 65 seals the one end 62*a* of the axial passage 62, and thereby, the pressure of the cooling medium in the axial passage 62 does not extend to the cylindrical space 55, and the end surface 51 of the rotor component member 50 is not subjected to the force toward the compressor side. Therefore, no force toward the compressor side is applied to the bolts 90 and the nuts 91. This makes it possible to avoid the excessive design of the bolt fastening structure and prevent damage to the bolt fastening portion.

As above, in the turbine rotor 10 in the embodiment, the bolt fastening portion having high reliability can be configured.

Here, there has been explained one example in which the above-described turbine rotor 10 includes the annular groove portion 42 on the outer edge side of the end surface 41 of the rotor component member 40 and the annular projecting portion 52 on the outer edge side of the end surface 51 of the rotor component member 50. The fitting structure of the end surface 41 of the rotor component member 40 and the end surface 51 of the rotor component member 50 at the bolt fastening portion is not limited to this configuration.

Figure 4:
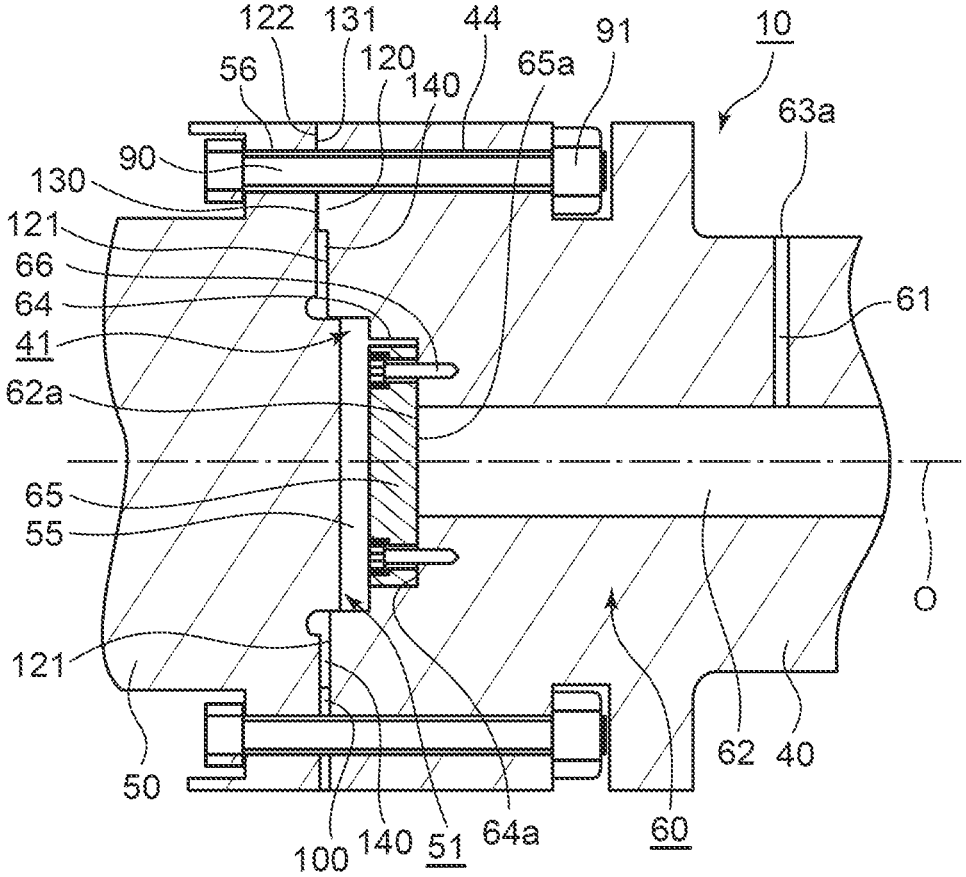
FIG. 4 is a view illustrating a meridian cross section of a joint portion in another configuration of the turbine rotor in the embodiment.
Figure 5:
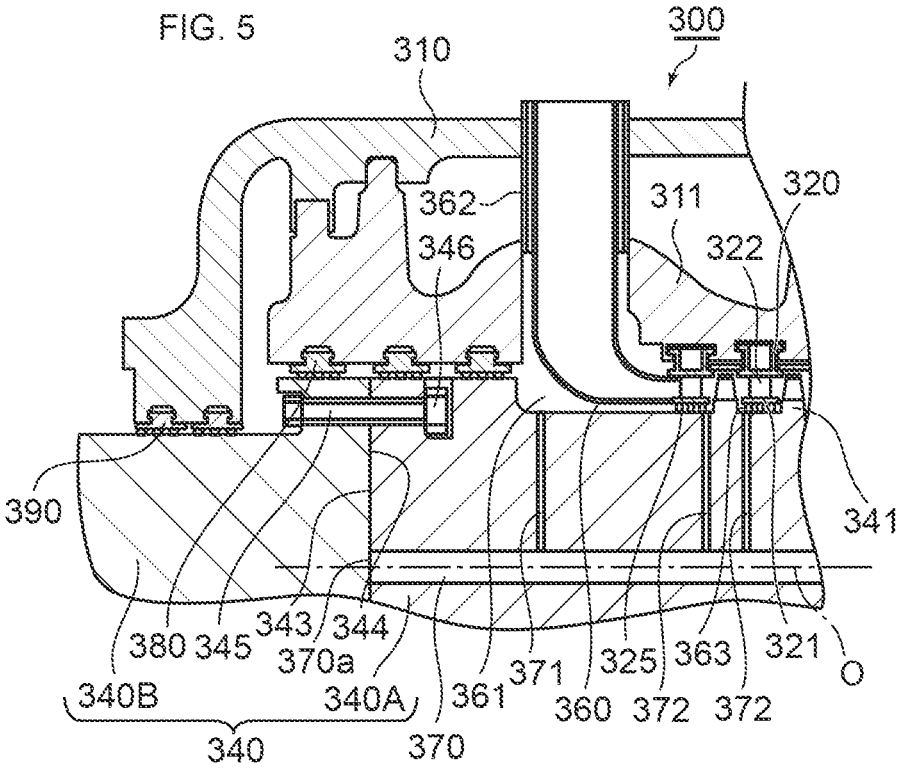
FIG. 5 is a view illustrating a meridian cross section of a turbine in a $CO_2$ gas turbine facility.

FIG. 4 is a view illustrating a meridian cross section of a joint portion in another configuration of the turbine rotor 10 in the embodiment.

As illustrated in FIG. 4, an annular projecting portion 120 projecting in the axial direction may be provided on the outer edge side of the end surface 41 of the rotor component member 40 over the circumferential direction, and an annular groove portion 130 recessed in the axial direction may be provided on the outer edge side of the end surface 51 of the rotor component member 50 over the circumferential direction.

Concretely, on the outer edge side (radially outer side) of the end surface (end surface on the compressor side) 41 of the rotor component member 40, the annular projecting portion 120 projecting in the axial direction is provided over the circumferential direction. That is, the outer edge side of the end surface of the rotor component member 40 includes the annular projecting portion 120 made of a step portion projecting to the compressor side in the axial direction over the circumferential direction.

In the meantime, on the outer edge side (radially outer side) of the end surface (end surface on the exhaust side) 51 of the rotor component member 50, the annular groove portion 130 recessed in the axial direction is provided over the circumferential direction. That is, the outer edge side of the end surface of the rotor component member 50 includes the annular groove portion 130 made of a step portion recessed to the compressor side in the axial direction over the circumferential direction.

Further, on the inner edge side (radially inner side) of the end surface of the annular projecting portion 120, an annular recessed portion 121 made of a step portion recessed to the exhaust side in the axial direction is formed over the circumferential direction.

Then, the rotor component member 40 and the rotor component member 50 are connected with the annular groove portion 130 and the annular projecting portion 120 being fitted to each other. The annular groove portion 130 and the annular projecting portion 120 are fitted to each other to be connected, and thereby positioning in the direction vertical to the axial direction can be easily performed.

When the annular groove portion 130 and the annular projecting portion 120 are fitted to each other, an abutting end surface 131, which is an annular bottom surface of the annular groove portion 130, and an abutting end surface 122 of the annular projecting portion 120, which is on the outer edge side relative to the annular recessed portion 121, come into contact with each other.

The abutting end surface 131 is an annular end surface on the outer edge side (radially outer side) of the annular bottom surface of the annular groove portion 130. The abutting end surface 122 is an annular end surface of the annular projecting portion 120, which is on the outer edge side relative to the annular recessed portion 121.

Here, as in the configuration illustrated in FIG. 2, there is the cylindrical space 55 formed in a clearance at the center portion of the joint portion of the rotor component member 40 and the rotor component member 50. Further, as illustrated in FIG. 4, there is an annular gap 140 between the annular recessed portion 121 formed on the inner edge side (radially inner side) of the end surface of the annular projecting portion 120 and the abutting end surface 122. This gap 140 is communicated with the cylindrical space 55.

In the configuration as well, in an abutting portion of the abutting end surface 122 and the abutting end surface 131, there may be provided the communication groove 100 communicating the gap 140 with the outside of the turbine rotor 10. Thereby, the cylindrical space 55 is communicated with the outside of the turbine rotor 10 through the gap 140 and the communication groove 100. Incidentally, the action and effect of having the communication groove 100 are as described above.

Further, in the above-described axial flow turbine 1, there has been explained one example in which the heat shield piece 33 is provided at the inner side of the inner shroud 31, but the axial flow turbine 1 is not limited to this configuration. For example, the heat shield piece 33 does not need to be provided at the inner side of the inner shroud 31. In this case, the sealing part is provided between the inner shroud 31 and the outer peripheral surface 40*a* of the rotor component member 40.

Further, in the above-described embodiment, there has been explained one example in which the axial passage 62 in the cooling structure part 60 is formed in the axial direction along the center axis O of the turbine rotor 10, but the above-described embodiment is not limited to this configuration.

The axial passage 62 may be formed in the axial direction, for example, in the rotor component member 40, on the radially outer side relative to the center axis O of the turbine rotor 10 and on the radially inner side relative to the outer peripheral surface 40*a* of the rotor component member 40. That is, the axial passage 62 may be formed between the center axis O and the outer peripheral surface 40*a* of the rotor component member 40.

In this case as well, at the joint portion by bolt fastening, the one end 62*a* of the opening axial passage 62 is sealed by the sealing member 65. Then, in this case as well, the same action and effect as those in the bolt fastening structure in the case where the axial passage 62 is formed along the center axis O of the turbine rotor 10 are obtained.

According to the above-described embodiment, in the turbine rotor that includes the bolt fastening structure and has the function of sealing the passage for the cooling medium at the fastening portion, the shaft power transmitting function and the sealing function at the fastening portion can be shared by separate structures, and the bolt fastening portion having high reliability can be configured.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalences are intended to cover such forms or modifications as would fall within the scope and spirit of the inventions.

What is claimed is:

1. A turbine rotor configured by joining a first rotor component member and a second rotor component member together by bolt fastening with a first end surface of the first rotor component member and a second end surface of the second rotor component member abutting on each other, the turbine rotor comprising:

a cylindrical recessed portion that is formed at the first end surface and is recessed in a center axis direction of the turbine rotor;

an axial passage that is bored in the center axis direction of the turbine rotor and that is connected with the cylindrical recessed portion and through which a cooling medium flows;

an introduction passage that introduces the cooling medium into the axial passage;

a discharge passage that penetrates from the axial passage into an outer peripheral surface of the turbine rotor and discharges the cooling medium; and a sealing member that is arranged in the cylindrical recessed portion and seals one end of the axial passage.

2. The turbine rotor according to claim 1, wherein at an abutting portion where the first end surface and the second end surface abut, the first end surface includes an annular groove portion that is formed on a radially outer side of the first end surface over a circumferential direction and is recessed in the center axis direction of the turbine rotor, and the second end surface includes an annular projecting portion that is formed on a radially outer side of the second end surface over the circumferential direction and projects in the center axis direction of the turbine rotor to be fitted to the annular groove portion.

3. The turbine rotor according to claim 2, wherein the sealing member is screwed to the first rotor component member.

4. The turbine rotor according to claim 3, further comprising:

a space portion that is formed in a clearance between the first end surface provided with the cylindrical recessed portion and the second end surface facing the cylindrical recessed portion; and a communication groove that is formed in the abutting portion where the first end surface and the second end surface abut and communicates the space portion with the outside of the turbine rotor.

5. The turbine rotor according to claim 2, further comprising:

a space portion that is formed in a clearance between the first end surface provided with the cylindrical recessed portion and the second end surface facing the cylindrical recessed portion; and a communication groove that is formed in the abutting portion where the first end surface and the second end surface abut and communicates the space portion with the outside of the turbine rotor.

6. The turbine rotor according to claim 1, wherein at an abutting portion where the first end surface and the second end surface abut, the first end surface includes an annular projecting portion that is formed on a radially outer side of the first end surface over a circumferential direction and projects in the center axis direction of the turbine rotor, and the second end surface includes an annular groove portion that is formed on a radially outer side of the second end surface over the circumferential direction and is recessed in the center axis direction of the turbine rotor to be fitted to the annular projecting portion.

7. The turbine rotor according to claim 6, wherein the sealing member is screwed to the first rotor component member.

8. The turbine rotor according to claim 7, further comprising:

a space portion that is formed in a clearance between the first end surface provided with the cylindrical recessed portion and the second end surface facing the cylindrical recessed portion; and a communication groove that is formed in the abutting portion where the first end surface and the second end surface abut and communicates the space portion with the outside of the turbine rotor.

9. The turbine rotor according to claim 6, further comprising:

a space portion that is formed in a clearance between the first end surface provided with the cylindrical recessed portion and the second end surface facing the cylindrical recessed portion; and a communication groove that is formed in the abutting portion where the first end surface and the second end surface abut and communicates the space portion with the outside of the turbine rotor.

10. The turbine rotor according to claim 1, wherein the sealing member is screwed to the first rotor component member.

11. The turbine rotor according to claim 10, further comprising:

a space portion that is formed in a clearance between the first end surface provided with the cylindrical recessed portion and the second end surface facing the cylindrical recessed portion; and a communication groove that is formed in an abutting portion where the first end surface and the second end surface abut and communicates the space portion with the outside of the turbine rotor.

12. The turbine rotor according to claim 1, further comprising:

a space portion that is formed in a clearance between the first end surface provided with the cylindrical recessed portion and the second end surface facing the cylindrical recessed portion; and a communication groove that is formed in an abutting portion where the first end surface and the second end surface abut and communicates the space portion with the outside of the turbine rotor.

* * * * *